United States Patent [19]

Gloe et al.

[11] Patent Number: 5,033,283

[45] Date of Patent: Jul. 23, 1991

[54] PRESS RAM

[75] Inventors: Karl-Heinz Gloe, Reichelsheim; Helmut Kreuzer, Munster, both of Fed. Rep. of Germany

[73] Assignee: AMP Incorporated, Harrisburg, Pa.

[21] Appl. No.: 557,275

[22] Filed: Jul. 24, 1990

[30] Foreign Application Priority Data

Jul. 27, 1989 [GB] United Kingdom ..... 8917144

[51] Int. Cl.[5] ..... B21J 7/46

[52] U.S. Cl. ..... 72/481

[58] Field of Search ..... 72/444, 481, 480; 403/264, 407.1, 322, 231; 83/698; 74/99 R, 102, 89; 100/918

[56] References Cited

U.S. PATENT DOCUMENTS 3,184,950 5/1965 Sitz ..... 72/331
4,274,332 6/1981 Nakamura ..... 72/481
4,587,830 5/1986 Mills ..... 72/481
4,790,173 12/1988 Boutcher, Jr. ..... 72/481

*Primary Examiner*—Lowell A. Larson
*Assistant Examiner*—M. J. McKeon
*Attorney, Agent, or Firm*—Bruce J. Wolstoncroft

[57] ABSTRACT

A press ram (6) is coupled to an applicator ram (20) to drive it, by means of a claw (54) which engages beneath an adaptor head (34) on the applicator ram (20). The claw (54) is formed on a slide (46) which is vertically shiftable in a guideway (42) in the press ram (6), the position of the slide (46) in its guideway (42) being adjustable by means of adjustment screw (62) from which projects eccentrically, a spigot (66) which engages in a slot (50) in the slide (46). The adjustment screw (62) can be rotated by means of a tool blade (B) to raise the slide (46) to take up slack between the press ram (6) and the applicator ram (20). A set screw (74) is provided for securing the slide (46) in its position of adjustment.

10 Claims, 5 Drawing Sheets

Fig. 2
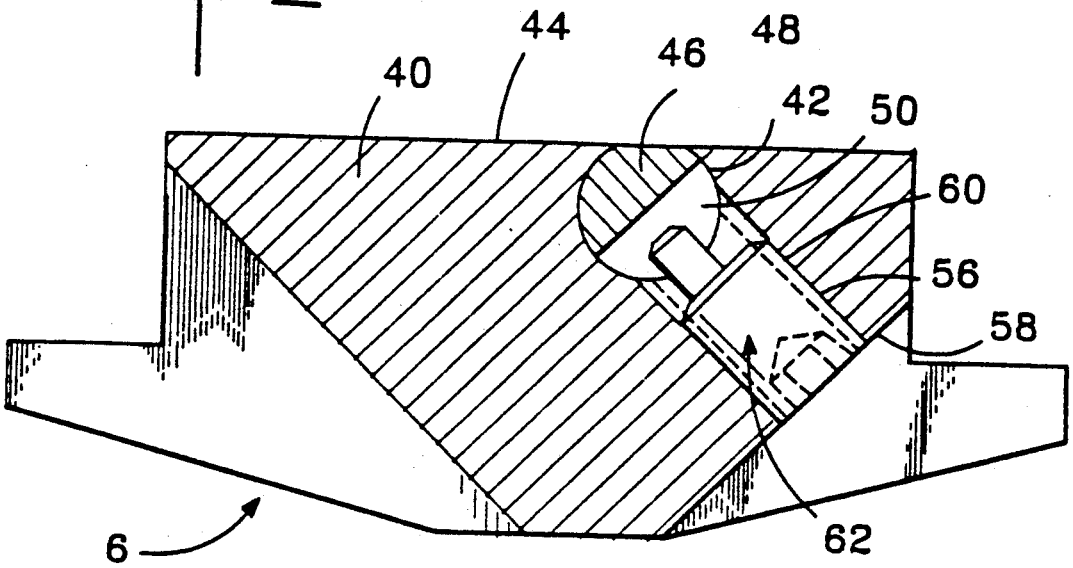
Fig. 4
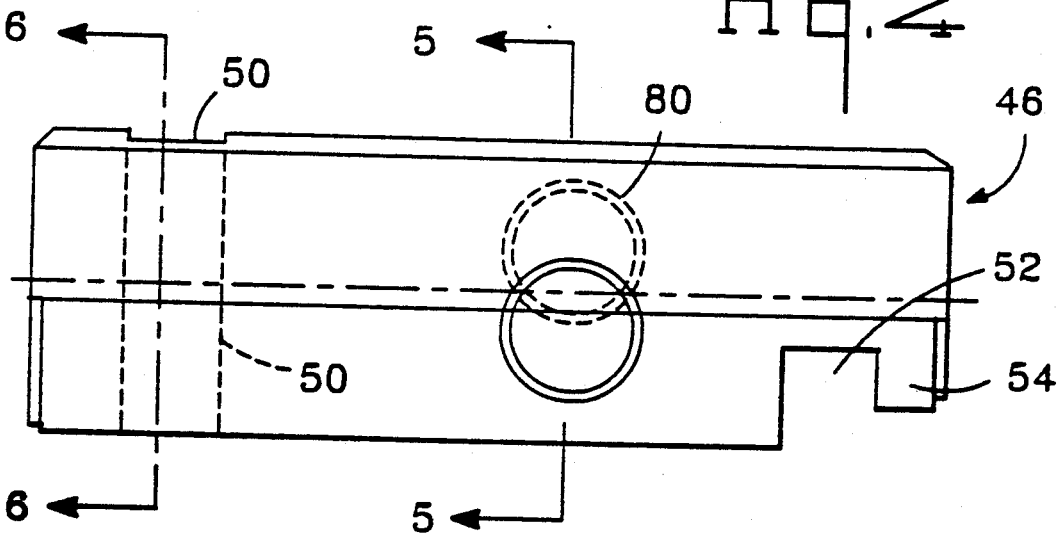
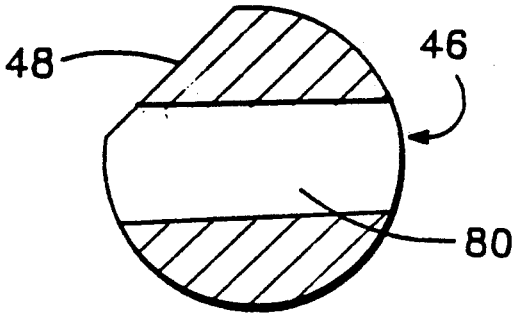
Fig. 5
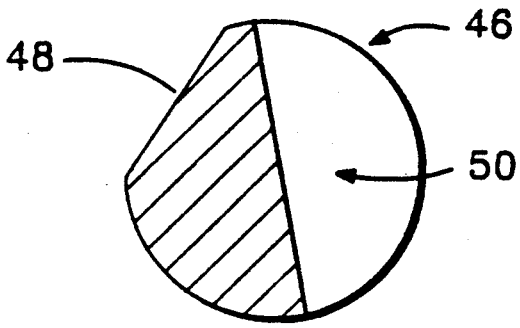
Fig. 6

PRESS RAM

This invention relates to a press ram and to a press ram, in combination with an applicator ram.

There is disclosed, for example, in U.S. Pat. No. 3,184,950, a press ram having a driving end from which projects a claw for engaging under an applicator head upon an applicator for applying electrical terminal leads, to be driven by the press ram.

For reasons of tolerance, there will be some vertical play between the claw and the adaptor head, resulting in chatter and wear when the rams are in operation.

In order to avoid this disadvantage, the claw, is, according to one aspect of the present invention, provided on a slide received in a guideway formed in the press ram and extending away from the driving end thereof, the ram also being formed with a lateral bore communicating with the guideway and with an external surface of the ram, an adjustment member which is rotatable in the bore having a spigot projecting therefrom eccentrically with respect to the axis of rotation of the adjustment member and being received in, and slidable along, a transverse recess in the slide; whereby the axial position of the slide in the guideway and thus the spacing of the claw from the driving end of the ram, can be adjusted by rotation of the adjustment member in its lateral bore.

Thus the claw can be very simply adjusted to draw the applicator ram towards the press ram in order to take up tolerances occurring between the claw and the adaptor head.

In order to secure the slide in its position of adjustment, against vibration caused by the operation of the rams, a set screw may be provided, which extends through a slot formed in the ram and through a tapped opening in the slide, a head on the set screw being engagable with the longitudinal margins of the slot, by screwing the set screw into the tapped opening, so that the slide is immoveable with respect to the press ram.

The slot preferably has a countersink accommodating the head of the set screw opening into the lateral surface of the ram and into the driving end of the ram, so that the set screw can traverse the full height of the slot which is elongate in the direction of the guideway.

The quideway may open into an external surface of the ram so as to reveal a flat on the slide, whereby the slide is non-rotatable in its guideway.

An abutment may be exchangably mounted on the driving end of the press ram at a position opposite to the claw, for engaging a counter abutment on the applicator ram beside the adaptor head thereof.

In an applicator ram constructed according to the teaching of U.S. Pat. No. 3,184,950 the applicator ram is provided with a series of such counterabutments, surrounding the adaptor head and being of different height. The counterabutments can be selectively positioned in alignment with said abutment to select the shut height of an electrical terminal crimping die on the applicator ram. The adjustment member is preferably a screw meshing with a screw thread of the bore.

According to another aspect of the invention, a press having a press ram arranged to be driven in vertical reciprocating motion and being coupled to an applicator ram to drive it in vertical reciprocating motion, the applicator ram having an adaptor thereon comprising a vertical shaft terminating in an adaptor head in the form of a radial flange, a claw projecting from the lower, driving, end of the ram engaging under the flange, is characterized in that the claw is provided on a slide received in a guideway formed in the ram and opening into the driving end thereof, a bore formed in the ram extending at right angles to the guideway receiving an adjustment member having an eccentric spigot engaged in a recess in the slide and being rotatable to adjust the axial position of the slide in its guideway, a set screw acting between the ram and the slide being provided for securing the slide in its position of adjustment.

In order to assist the operator, the adjusting member may be arranged to be rotatable by only half a turn in either sense.

An embodiment of the invention will now be described by way of example with reference to the accompanying drawings in which;

FIG. 2 is a view taken on the lines 2—2 of FIG. 1;

FIG. 3 is an isometric view of the applicator;

FIG. 4 is a side view of a slide which is shown in FIG. 2;

FIG. 5 is a view taken on the lines 5—5 of FIG. 4;

FIG. 6 is a view taken on the lines 6—6 of FIG. 4;

Figure 1:
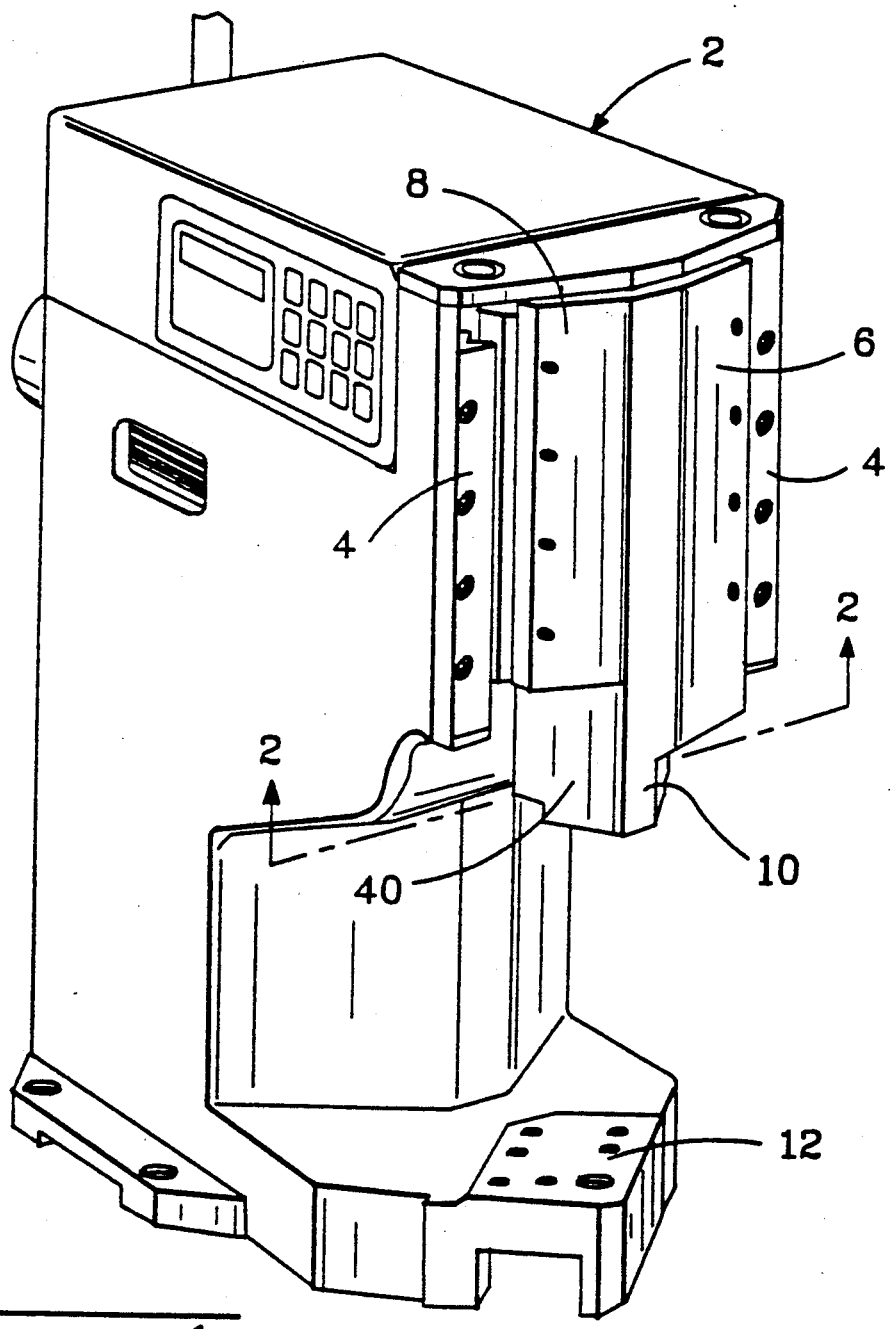
FIG. 1 is an isometric view of a press having a press ram for driving an applicator for applying electrical terminals to leads.

The press shown in FIG. 1, comprises a press frame 2 in which is mounted for vertical reciprocating movement, in bearings 4, a press ram 6 driven by an electric motor (not shown) in the frame 2. The ram 6 has an upper end 8 and a lower, driving, end 10. Beneath the ram 6, the frame 2 has an emplacement 12 for an applicator 14 shown in FIG. 3. The applicator 14 comprises ram housing 16 containing an applicator ram 20 terminating at its upper end in an adaptor 22 and at its lower end in a crimping die 24 for crimping strip form electrical terminals T to leads (not shown). The terminals T are fed towards a crimping anvil 26 cooperating with the die 24, by means of a feed finger 28 operated by a pneumatic drive system 30.

Figure 7:
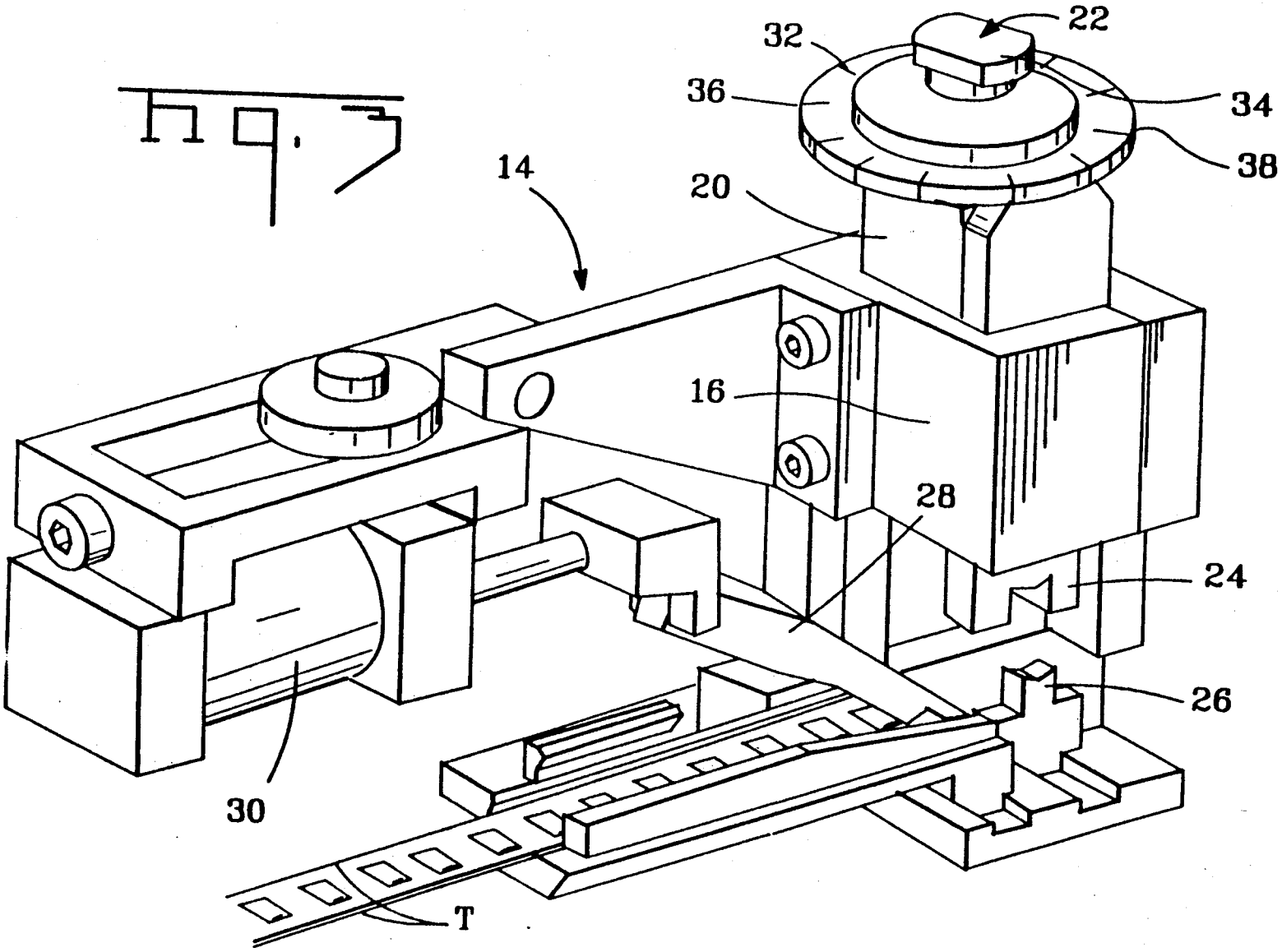
FIG. 7 is a fragmentary side view, shown partly in section illustrating the press ram when coupled to the applicator ram.
Figure 7:
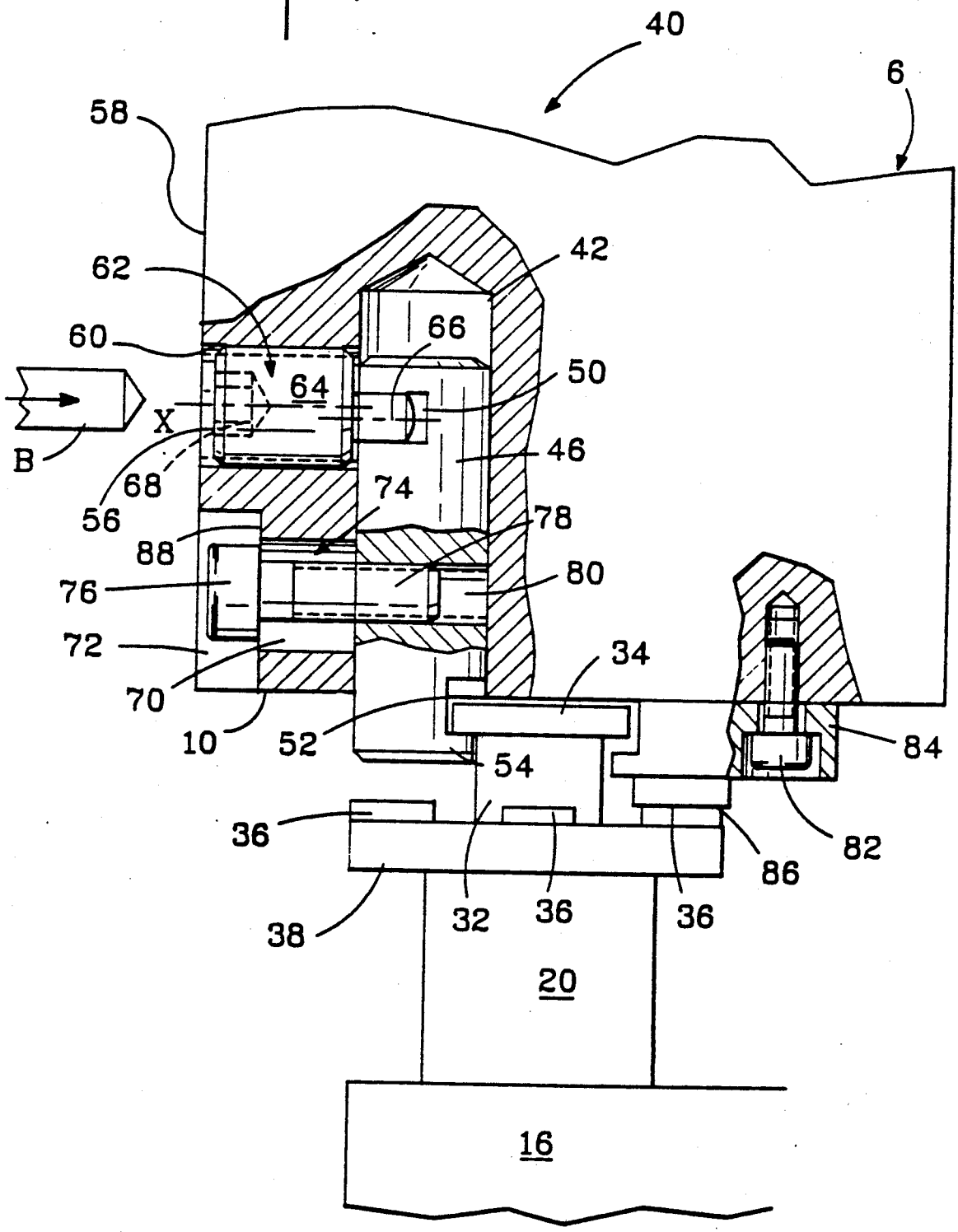
Figure 8:
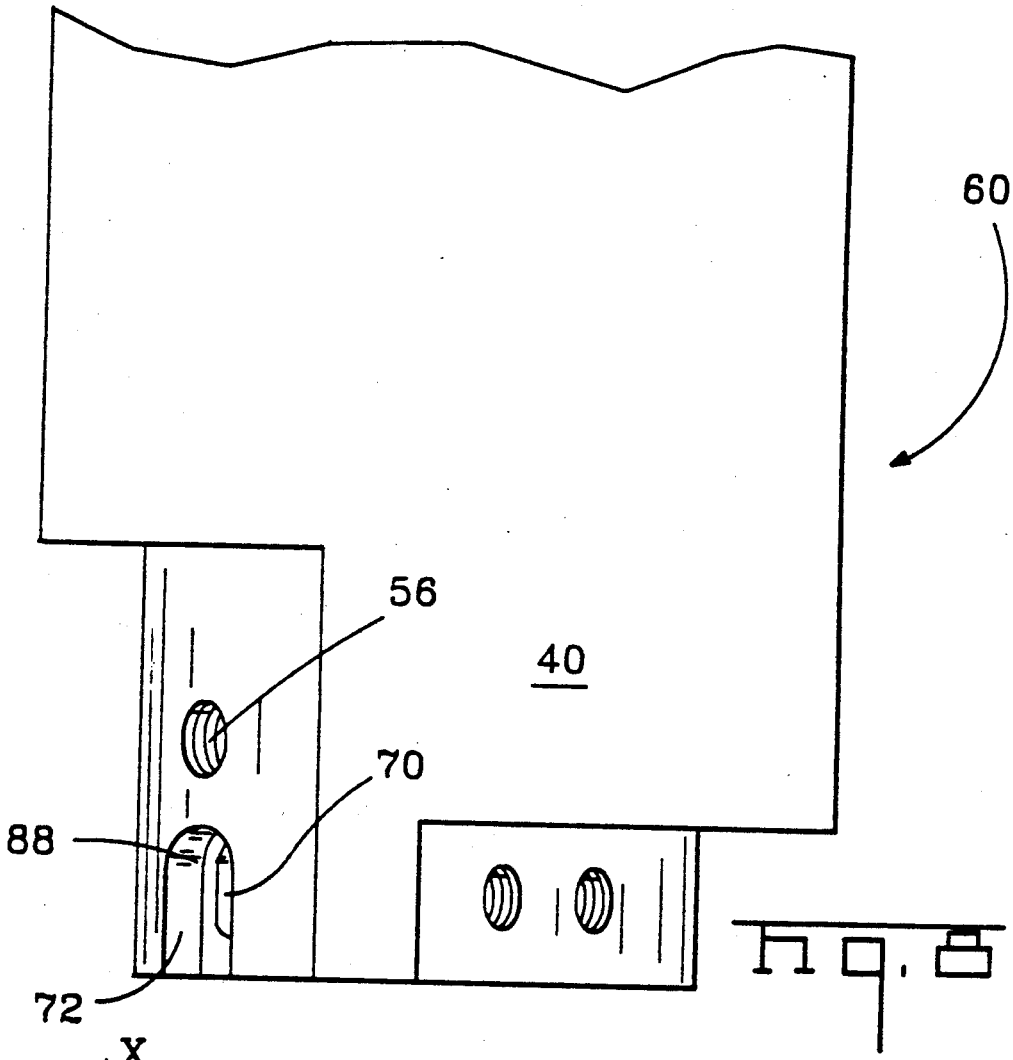
FIG. 8 is an enlarged, fragmentary side view of the press ram.

The adaptor 22 comprises as best seen in FIG. 7, a vertical shaft 32 terminating in an adaptor head 34 the form of a radial flange. About the shaft 32 are distributed several flat counterabutments 36 of different heights which are disposed on a rotary plate 38.

Figure 9:
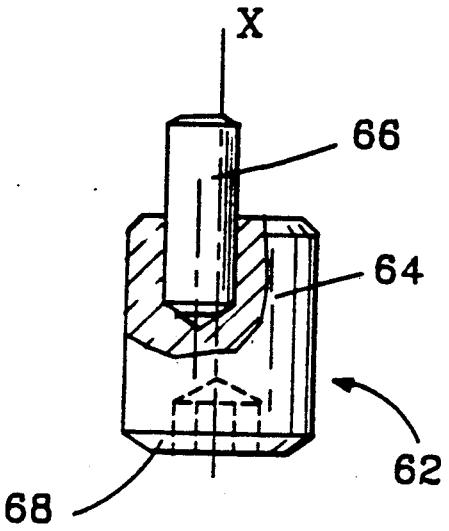
FIG. 9 is an elevational view shown partly in section, of an adjustment screw for the press ram.

The press ram 6 terminates, towards its driving end 10, in a reduced cross section portion 40 in which is formed a vertical guideway 42 which opens at its lower end into the end 10 of the ram 6 and extends rectilinearly away therefrom at right angles thereto. The guideway 42 also opens into the rear face 44 of the ram portion 40, as shown in FIG. 2. The guideway 42 is otherwise of circular crossection. Slidably arranged in the guideway 42, is a slide 46 in the form of a bolt which is of circular cross section excepting that it has flat face 48 which is flush with the face 44 of the ram portion 40 and is exposed rearwardly of the portion 40 as shown in FIG. 2; whereby the slide 46 cannot rotate in the guideway 42. There is formed in the slide 46, proximate to its upper end, a recess 50 in the form of a through slot extending at right angles to the longitudinal axis of the slide 46 and thus at right angles to its path of movement. As shown in FIG. 6, the recess 50 extends substantially half way into the slide 46. The slide 46 is formed, proximate, to its lower end, with a notch 52 defining a claw 54 and which is best seen in FIG. 4. The claw 54 is of constant cross sectional area and extends normally of the longitudinal axis of the slide 46. A tapped bore 56 formed in the ram portion 40, extends at right angles to the guideway 42 and communicates at one end therewith, the other end of the bore 56 opening into an obliquely extending forward face 58 of the ram portion 40 best seen in FIG. 2. Meshing with the screw thread 60 of the bore 56 is an adjustment member in the form of screw 62 having a circular cross section screw body 64 in which is secured, as best seen in FIG. 9, a spigot 66 which is positioned eccentrically with respect to the axis of rotation X of the screw body 64. The spigot 66, which projects from the inner end of the body 64, extends into the recess 50 and is slidable therealong so that the eccentricity of the spigot 66 is taken up as the screw 62 is rotated. At its end remote from the spigot 66, the body 64 is formed with hexagonal cross section recess 68 for receiving a tool blade B (FIG. 7) for driving the screw 62 inwardly and outwardly of the bore 56. The ram portion 40 is also formed with a vertically elongate slot 70 having a countersink 72 opening into the face 58 and into the driving end 10 of the ram 6. A set screw 74 has a head 76 in the countersink 72, and a shank 78 received in a tapped opening 80 in the slide 46, extending at right angles to the longitudinal axis thereof.

An abutment block 84 is exchangeably secured to the end 10 of the ram 6, and opposite to the claw 54, by means of a screw 82. The block 84 has a flat abutment surface 86.

When setting up the press and the applicator for operation, the adaptor head 34 is engaged in the notch 52 of the slide 46 and the plate 38 is rotated to position a desired counter abutment 36 beneath the surface 86 of the block 84 according to the crimp height required for the terminals T, the screw 62 having been rotated in its bore 56 by means of the tool blade B, to lower the slide 46 to allow the adaptor head 34 to be easily inserted into the notch 52 and the plate 38 to be appropriately rotated. The set screw 74 is in a slackened off condition. The adjustment screw 62 is then rotated by means of the tool blade B to cause the spigot 66 to raise the slide 46 to an extent to ensure that there is no play between rams 6 and 20. As the slide 46 is moved, the set screw 74 is shifted along the slot 70 thereby permitting the movement of the slide 46. The slide 46 having been correctly adjusted, the set screw 76 is driven home into the tapped opening 80 whereby the screw head 76 is pressed against the margins 88 of the slot 70 so that the slide 46 is securely held in its position of axial adjustment against the vibration occasioned by the operation of the rams 6 and 20.

Figure 10:
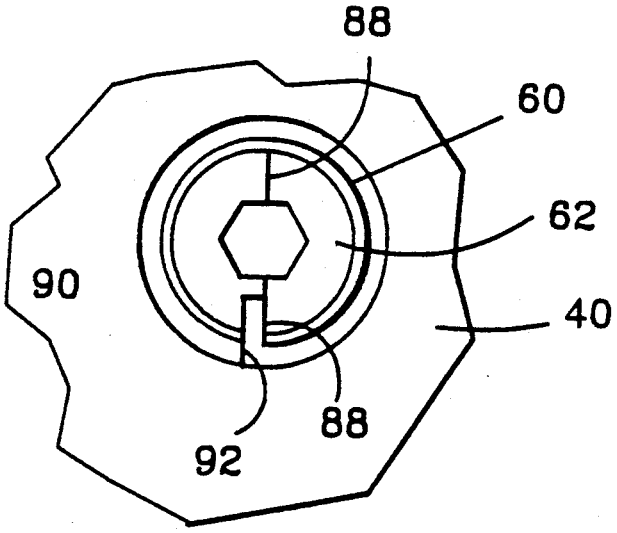
FIG. 10 is a fragmental side view of FIG. 7 illustrating a modification.

In order to assist the operator in determining which way to turn the adjustment screw in order to raise or lower the slide 46, the adjustment screw may be rotatable through only 180° in either sense. To this end, as shown by way of example in FIG. 10, the adjustment screw 62' may be formed at its outer end with a pair of diametrically extending flats 88 defining a semi-circular recess 90 receiving a projection 92 on the ram portion 40, cooperating with the flats 88 to limit the rotation of the screw 62' as described above.

Although it is preferred that the adjustment member be in the form of a screw, the bore 56 being accordingly tapped, both the bore and the adjustment member could have frictionally cooperating surfaces of some other kind.

We claim:

1. A press ram (6) having a driving end (10) from which projects a claw (54) for engaging under an adaptor head (34) upon an applicator ram (20) to be driven by the press ram (6); characterized in that the claw (54) is provided in a slide (46) received in a guideway (42) formed in the press ram (6) and extending away from the driving end (10), the press ram (6) also being formed with a lateral bore (56) communicating with the guideway (46) and with an external surface (58) of the press ram (6), an adjustment member (62) which is rotatable in the bore (56) having a spigot (66) projecting from the adjustment member eccentrically with respect to the axis of rotation (X) of the adjustment member (62) and being received in, and slidable along, a transverse recess (50) in the slide (46); whereby the axial position of the slide (46) in the guideway (42) and thus the spacing of the claw (54) from the driving end (10) of the press ram (6) can be adjusted by rotating the adjustment member (62) in the lateral bore (56).

2. A press ram according to claim 1, characterized by a set screw (74) extending through a slot (70) formed in the ram (6), and through a tapped opening (80) in the slide (46), a head (76) on the set screw (74) being engageable with the longitudinal margins (88) of the slot (70) by screwing the set screw (74) into the tapped opening (80), to secure the slide (46) in position of axial adjustment.

3. A press ram according to claim 2, characterized in that the tapped opening (80) is positioned intermediate the claw (54) and the recess (50), the slot (70) having a counter sink (72) accommodating the head (76) of the set screw (74) and opening into a lateral surface (58) of the press ram (6).

4. A press ram according to claim 1, 2 or 3, characterized in that the guideway (42) opens into an external surface (44) of the press ram (6), a flat (48) on the slide (46) being flush with said external surface (44).

5. The press according to claim 1, characterized in that the guideway (42) extends in the driving direction of the press ram (6), the lateral bore (56), the claw (54) and the recess (50) extending at right angles to the guideway (42), the claw (54) being defined by a lateral notch (52) in the slide (46).

6. A press ram according to claim 1, characterized by an abutment (84) exchangably mounted on the driving end (10) of the press ram (6) at a position opposite to the claw (54) for engaging a counter abutment (36) on the applicator ram (20), beside the adaptor head (34).

7. A press ram according to claim 1, characterized in that the lateral bore (56) is tapped, the adjustment member being in the form of a screw (62) meshing with the screw thread (60) of the bore (56).

8. A press ram according to claim 1, characterized in that the adjustment member (62) is rotatable only through 180° in the lateral bore (56) in either sense.

9. A press having a press ram (6) arranged to be driven in vertical reciprocating motion and being coupled to an applicator ram (20) to drive it in vertical reciprocating motion, the applicator ram (20) having an adaptor thereon comprising a vertical shaft (32) terminating in an adaptor head in the form of a radial flange (34), a claw (54) projecting from a lower driving end

(10) of the press ram (6) engaging under the flange (34); characterized in that the claw (54) is provided on a slide (46) received in a guideway (42) formed in the press ram (6) and opening into the driving end (10), a bore (56) formed in the press ram (6) extending at right angles to the guideway (42) receiving an adjustment member (62) having an eccentric spigot (66) engaged in a recess (50) in the slide (46) and being rotatable to adjust the axial position of the slide (46) in the guideway (42), a set screw (74) being provided for securing the slide (46) in the position of adjustment.

10. A press ram and applicator ram according to claim 9, characterized by an abutment (84) projecting from the driving end (10) the press ram (6) opposite to the claw (54) and a series of counter abutments on the applicator ram (20) distributed about the vertical shaft (32) and being selectively positionable in alignment with the abutment (84), rotation of the adjustment screw (62) serving to draw the abutment (84) and the selected counter abutment (36) together.

* * * * *